United States Patent [19]

Lace, Jr.

[11] Patent Number: 4,809,578

[45] Date of Patent: Mar. 7, 1989

[54] MAGNETIC FIELD SHAPING IN AN ACOUSTIC PICK-UP ASSEMBLY

[76] Inventor: Donald A. Lace, 5041 Galway Cir., Huntington Beach, Calif. 92649

[21] Appl. No.: 73,273

[22] Filed: Jul. 14, 1987

[51] Int. Cl.[4] ..... G10H 3/08; G10H 3/18

[52] U.S. Cl. ..... 84/1.15; 84/1.16

[58] Field of Search ..... 84/1.16, 1.15, 1.14, 84/1.04-1.06; 336/130, 132

[56] References Cited

U.S. PATENT DOCUMENTS

| | | | |
|---|---|---|---|
| 2,089,171 | 8/1937 | Beauchamp | 84/1.15 |
| 2,896,491 | 7/1959 | Lover | 84/1.15 |
| 3,066,567 | 12/1962 | Kelley, Jr. | 84/1.15 X |
| 3,183,296 | 5/1965 | Miessner | 84/1.15 |
| 3,236,930 | 2/1966 | Fender | 84/1.15 |
| 3,588,311 | 6/1971 | Zoller | 84/1.15 |
| 3,983,778 | 10/1976 | Bartolini | 84/1.15 |

*Primary Examiner*—Arthur T. Grimley
*Assistant Examiner*—John G. Smith
*Attorney, Agent, or Firm*—I. Michael Bak-Boychuk

[57] ABSTRACT

An electromagnetic pickup for use in sensing the mechanical motion of strings includes a ferromagnetic housing of elongate, longitudinally recessed form in which a ferromagnetic core is received. The core includes a plurality of coplanar, spaced, finger-like projections directed at the walls of the recess. Both the walls of the recess and the finger-like projections of the core are permanently magnetized to a common magnetic polarity and thus will concentrate by magnetic repulsion the flux into the gap between the projections. A coil wound around the core then senses the flux changes of these concentrated flux fields due to string motion.

4 Claims, 3 Drawing Sheets

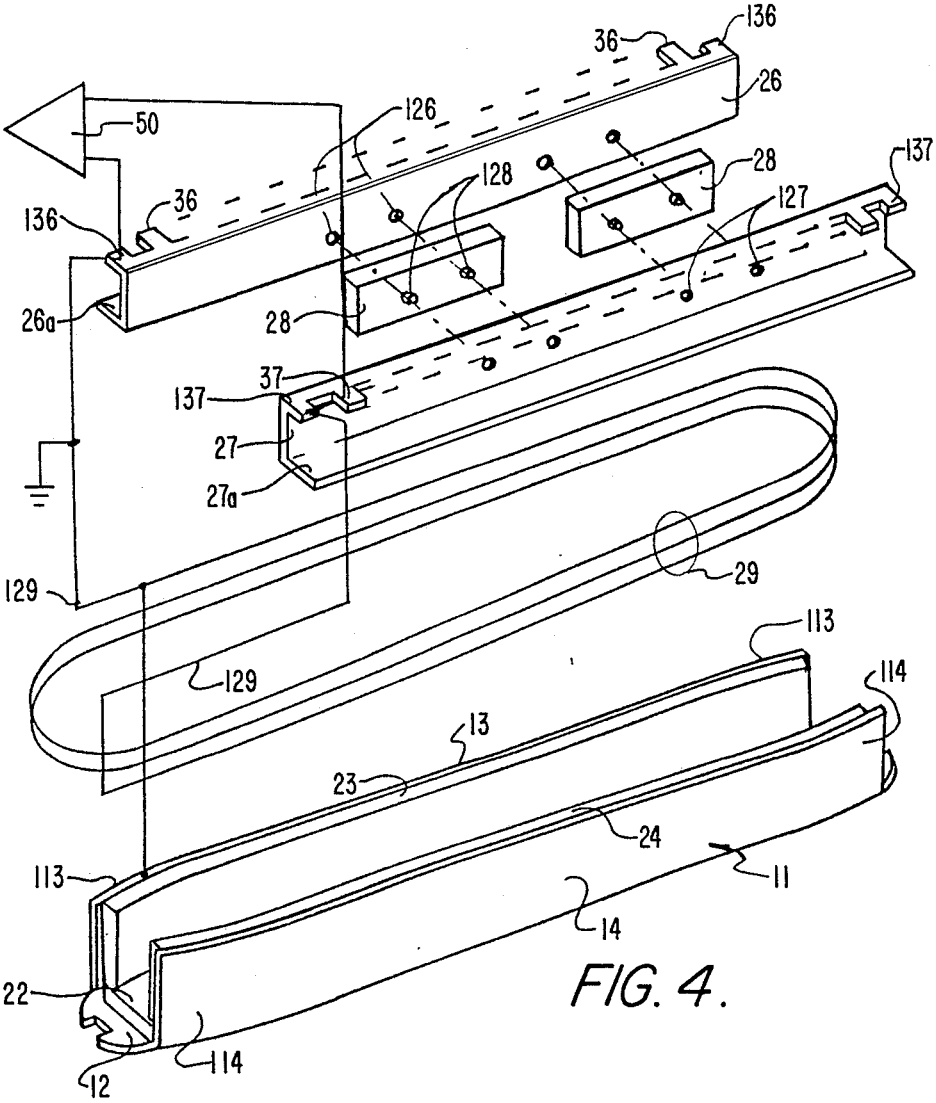
FIG. 4.
FIG. 5.
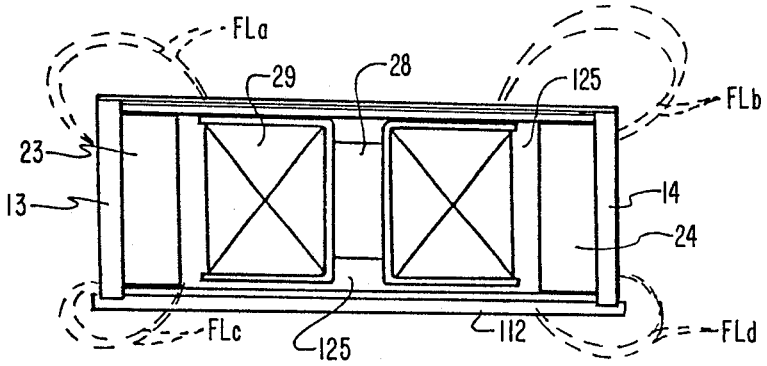

MAGNETIC FIELD SHAPING IN AN ACOUSTIC PICK-UP ASSEMBLY

BACKGROUND OF THE INVENTION

1. Field of the Invention

The present invention relates to acoustic pick-up devices and, more particularly, to electromagnetic pick-ups for use with string instruments.

2. Prior Art Statement

Each of the prior art references cited by the applicant utilizes core to core field flux concentration. The applicant, in distrinction, concentrates the fields by magnetic repulsion effected by the same magnetic polarity in adjacent core structures. Thus, unlike the art submitted, the applicant forms a flux field shaped by repulsion in the region where the strings are aligned while the prior art relies on magnetic flux paths determined by adjacent, opposingly magnetized poles.

DESCRIPTION OF THE PRIOR ART

Electromagnetic pick-ups or transducers for amplifying the mechanical vibrations of a stringed instrument are extensively practiced in the art. Typically such pick-ups are characterized by one or more electrical windings or coils adjacent ferromagnetic pieces which then respond to the vibrations of ferromagnetic strings in their vicinity. Inherent in this arrangement is the reverse magnetic effect on the strings, a magnetic effect which acts to damp the string modes of motion. This damping effect is dominated by the local velocity of the string and thus has a selective influence on those modes of string motion which are most pronounced next to the pickup. Thus, for example, the modes of string motion which align the antinodes over the pickup will be damped to a larger extent than the nodes aligning their nodes thereat.

In consequence not just the damping but also selective distortion of the harmonic content is present in a typical pick-up, resulting in the loss of "presence" due to the quicker decay and a distorted sound image presented to the amplifier.

In the past, various magnetic arrangements have been devised to accommodate the damping problem. Exemplary approaches resolving this problem may be found in U.S. Pat. No. 4,133,243 to Nunan et al, U.S. Pat. No. 3,916,751 to Stick, U.S. Pat. No. 3,588,311 to Zoller, and others. While suited for the purposes described each of these prior art teachings attends to only one or the other aspect of the problem.

Accordingly, pick-up arrangements which resolve both the damping and the harmonic effect are extensively sought and it is one such arrangement that is disclosed herein.

SUMMARY OF THE INVENTION

Accordingly, it is the general purpose and object of the present invention to provide a pick-up assembly conformed for distributed magnetic flux.

Other objects of the invention are to provide an electromagnetic pick-up for stringed instruments which is substantially linear for all modes of string motion.

Yet further objects of the invention are to provide an electromagnetic pick-up conformed to develop a shielding magnetic field thereabout.

Further objects of the invention are to provide an acoustic pick-up which is easily produced and is operative without substantial adjustment.

Briefly, these and other objects are accomplished within the present invention by way of a pick-up assembly comprising an elongate C-sectioned ferromagnetic case or enclosure lined on the interior surfaces thereof with planar permanent magnet pieces each aligned to present the same magnetic polarity into the interior thereof. This magnetic polarity alignment results in a distorted flux field pattern around each of the case edges, which, in consequence to their polarity, repel each other into opposing distorted fields around each edge. An elongate ferromagnetic core piece characterized by two recessed, symmetrically aligned elements around which an elongate winding is made, is then fixed in the interior of the case. The exterior exposed edge of each element, moreover, is shaped as a row of teeth directed towards the case sides.

Since the resulting magnetic polarity of the core piece elements is the same as the adjacent polarity at the magnets lining the case sides the apertures between the teeth act as magnetic flux shaping structures developing at each aperture radially shaped flux patterns to the case edge. This uneven, repetitively arranged, flux pattern then provides the necessary flux gradient resolving any transverse string motion into an induced electrical signal in the coil. Moreover, the repulsed magnetic fields, each comprising the foregoing bunched field groups extending in a row to the corresponding edge, align in opposite directions and thus will induce cancelling current flows in the strings oscillating in these fields. This cancellation of induced current (back EMF) effectively cancels all magnetic source of string damping while the radial field patterns at the apertures respond to the unequal local string motion associated with harmonic modes. This inequality is then useful to bring out all of the string modes of motion while the main source of damping is cancelled out.

As a result a pick-up is devised which is particularly sensitive to all the harmonics in the string without the unwanted damping consequence found in most pick-up arrangements. Moreover, the transversely symmetrical magnetic field patterns thus developed effect, at distance, a barrier field which then shields the coil of the pick-up from external noise (e.g., electromagnetic radiation). A self-shielding string motion pick-up is thus devised with particular attention to harmonic content and reduction of damping, and self effected shielding from external radiation.

BRIEF DESCRIPTION OF THE DRAWINGS

FIG. 4 is a perspective illustration, separated by parts, of the pickup assembly shown in FIG. 1; and FIG. 5 is yet another sectional view of an alternative embodiment of the inventive pickup.

DESCRIPTION OF THE PREFERRED EMBODIMENTS

Figure 1:
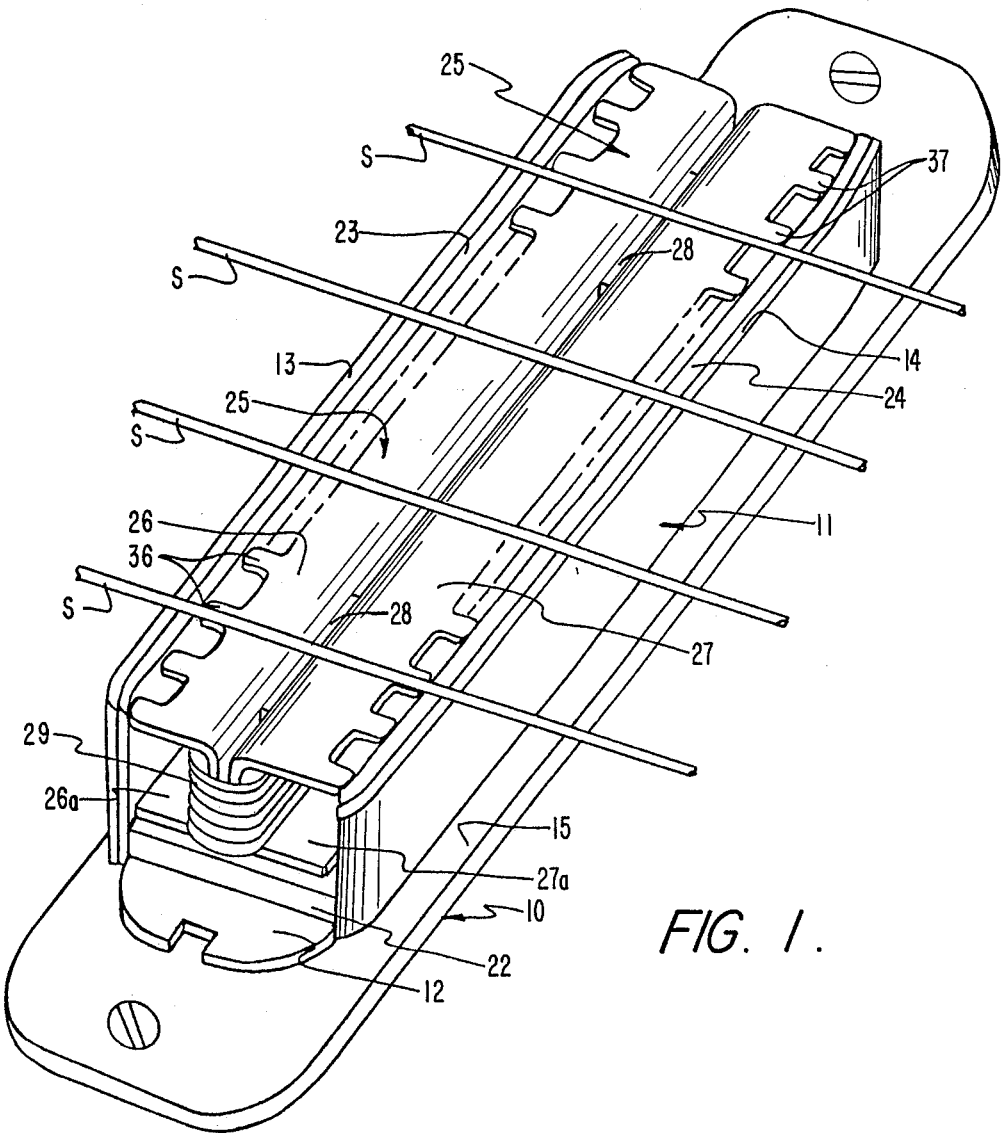
FIG. 1 perspective illustration of the inventive pickup in accordance with the first embodiment thereof.

While the principles of the present invention may be variously implemented, the examples set out herein are particularly useful in the exposure thereof Those considering the instant teachings, accordingly, are invited to the examples herein for the tutorial aspects and not as an expression of limitations which are solely confined to the appended claims By reference to FIGS. 1–4 the first embodiment of the invention, generally designated by the numeral 10, comprises an elongate ferromagnetic channel or case 11 characterized by a center surface 12 forming the base between two orthogonal, parallel side surfaces 13 and 14. To effect mechanical isolation from the surface of an instrument 1 case 11 at the center surface 12 is fastened to a mounting plate 15 by fasteners 16 extending through resilient bustrings 16*a*. Plate 15 is then fixed to the surface of instrument I subjacent strings S thereon. As thus mounted case 11 is aligned transversely under the strings S to sense the motion thereof in the manner set out below.

More specifically, each of the surfaces 12, 13 and 14, on the interior thereof, include permanent magnet strips 22, 23 and 24, respectively, each adhesively mounted to present a common magnetic polarity to the channel interior. Thus, for example, strips 22, 23 and 24 each present their north N magnetic polarity to the center of the channel with a consequent south polarity S impressed on the case 11. A coil structure, generally at 25 is then fixed within this common polarity interior, including an elongate ferromagnetic frame comprising two channel pieces 26 and 27 fixed back to back to each other across insulating spacers 28 within a gap defined therebetween. In this form these ferromagnetic pieces provide a structure onto which a pickup coil 29 is wound. This combined coil structure 25 is once again adhesively affixed within the case interior by an electrically insulating adhesive bond 31 of the lower frame surfaces 26*a* and 27*a* to the exposed face of the center magnetic strip 22. In consequence the frame pieces 26 and 27 are magnetically polarized to the N polarity of the adjacent faces of strips 22, 23 and 24.

At the exterior exposed edges frame pieces 26 and 27 are each conformed to define rows of tooth like projections or teeth 36 and 37 directed respectively towards the N polarized surfaces of strips 23 and 24. The apertures between the adjacent teeth 36 and 37, together with the adjacent strip surfaces thus define magnetic flux bottles or geometric flux shaping forms. Specifically, since each frame piece 26 and 27 and the teeth 36 and 37 formed therein are polarized to the same magnetic polarity as the adjacent strips 23 and 24, a flux bottle effect is developed in each aperture. Each aperture, therefore, proximate its center forms effectively a vector source FS from which flux lines FL, in a radial fan out, extend to the nearest oppositely polarized edge 13 and 14.

Figure 3:
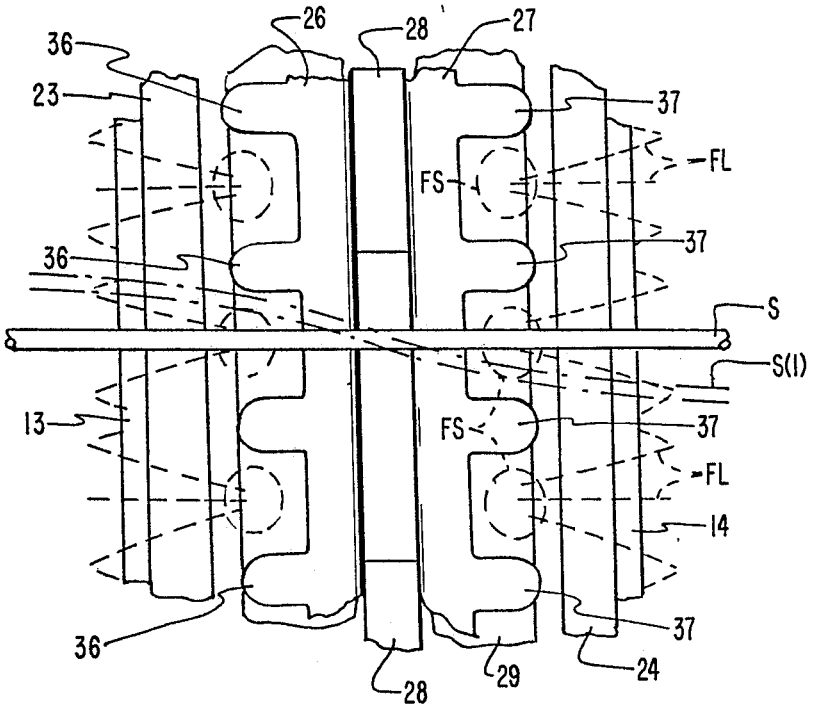
FIG. 3 top view detail of the pickup assembly shown in FIG. 1 illustrating the magnetic flux distribution associated therewith.

By particular reference to FIG. 3 illustrating two such radial fan outs of lines FL those skilled in the art will note that the fan outs are oppositely aligned. A stationary string S within these two fanouts will thus produce no induced effect. When, however, the string excited to a waveform shown at S(1) the portion of the string passing in the direction of the fan out will cut fewer flux lines than the string portion turning against the resolved fan angle. Accordingly, as this waveform S(1) passes along the strings induced in equalities result, enhancing the induction of the harmonics into the coil 25.

Figure 2:
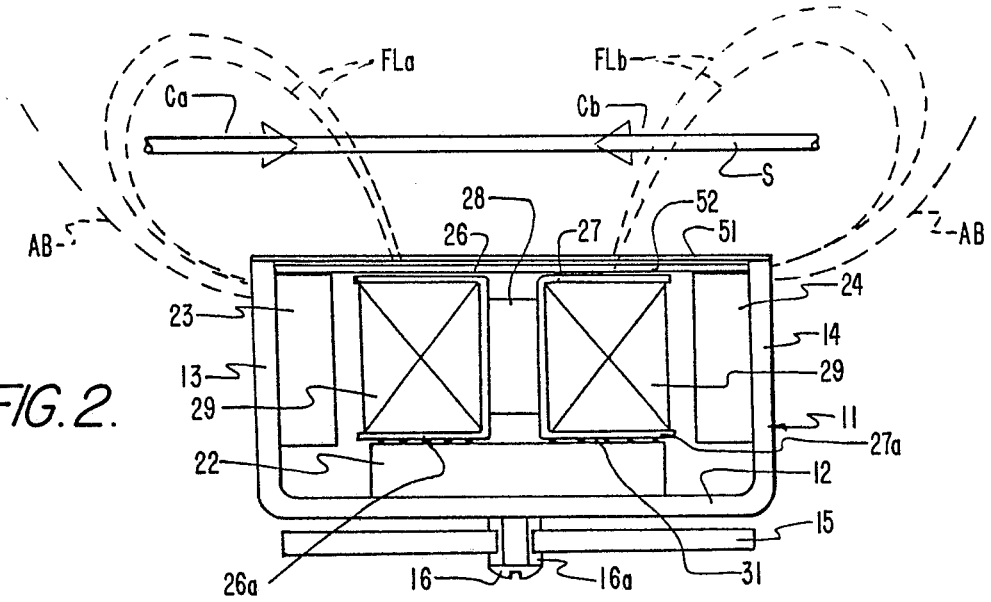
FIG. 2 is a sectional view taken along line 2—2 of FIG. 1.

Of course since both flux patterns emerging from the apertures are of equal polarity they will repel each other to the symmetrical, vertical, flux patterns FLa and FLb shown in FIG. 2. Thus the large motions of the string S induce opposite current vectors Ca and Cb into the string which then cancel each other, cancelling the principal source of electromagnetic string damping.

As a consequence, this pickup arrangement enhances the sensitivity to harmonic content while reducing the main component of damping. Moreover the substantially equal flux patterns FLa and FLb distort the background or ambient flux AB around the pickup 10 thus forming a barrier or shield to ambient or background electromagnetic noise. This barrier extends to the structure of the channel 11 which, moreover, may be grounded to the signal ground from coil 29 extending to any conventional preamplifier 50. Thus the pickup case and the signal are tied to a simple common ground, limiting the effect of any ground loops induced by the background noise. In addition, a non magnetic conductive membrane 51 (shown in FIG. 2) may be stretched across the edges 13 and 14, separated by an insulating strip 52 from the coil assembly. In this form full external shielding is effected around the pickup coil both for electromagnetic and for electrostatic isolation.

As shown in more detail in FIG. 4 pieces 26 and 27 may be provided with axially aligned holes 126 and 127 which then receive alignment projections 128 formed on the surfaces of spaces 28. To limit the affect of end fringes both the channel 11 and the tooth dimension are turned inward proximate the ends as curvatures 113 and 114 and reduced end teeth 136 and 137. A length of insulated wire 129 is then wound thereabout, as the foregoing coil 29, and thereafter connected at the ends thereof to the end teeth 136 and 137 respectively. Thus pieces 26 and 27 function as the electrical terminals across the coil with one of the pieces (shown as the piece 26) grounded both the case 11 and the preamplifier ground. These connections may be variously arranged and may include tabs (not shown) extending from each piece for soldering of connecting convenience.

In a further alternative, illustrated in FIG. 5, a double magnetic field pattern may be effected. For convenience in this illustration like numbered parts provide a like function to that previously described. In this embodiment edges 13 and 14 are mounted in a non ferrous base 112 and the coil assembly 25 is fixed thereon by any conventional potting compound 125. In consequence flux patterns FLa and FLb are again provided along with downwardly directed flux patters FLc and FLd. This flux arrangement is then useful to induce the mechanical motion of the sound board, or any other surface, into the coil assembly 25.

Thus a convenient signal pick off is devised useful in a variety of applications.

Obviously, many modifications and changes may be made to the foregoing without departing from the spirit of the invention. It is therefore intended that the scope of the invention be determined solely on the claims appended hereto.

What is claimed is:

1. A pick-up assembly useful in developing an electromagnetic signal indicative of movement by strings adjacent thereto, comprising:

an elongate, ferromagnetic housing aligned subjacent said strings and defined by an exterior ferromagnetic shell including an elongate recess formed therein characterized by opposed side walls and a bottom wall and provided with a plurality of permanently magnetized elongate segments deployed longitudinally on said side walls within said recess to present a common magnetic polarity on the interior of said shell;

as elongate ferromagnetic core deployed within the interior of said recess and aligned, in spaced alignment, between said magnetized segments, said core including a laterally aligned peripheral groove defined by an upper and a lower surface, said upper surface including a plurality of spaced, coplanar projections, each directed towards the proximate one of said magnetized segments within said recess; and a conductor wound about said core within said peripheral groove between said upper and lower surfaces, whereby magnetic flux developed by said magnetized segments is localized between said projections for radial fan-out therefrom to said housing, said flux extending towards said strings.

2. Apparatus according to claim 1, wherein:

said core includes a first and second ferromagnetic piece, each of a grooved section, separated from each other by insulating spacers.

3. Apparatus according to claim 2, wherein:

said first and second pieces are mounted in said interior recess of said housing in magnetic proximity therewith.

4. Apparatus according to claim 3, wherein:

said first and second pieces are electrically insulated from said housing.

* * * * *

UNITED STATES PATENT OFFICE

CERTIFICATE OF CORRECTION

Patent No. 4,809,578 Dated March 7, 1989

Inventor(s) Donald A. Lace

It is certified that error appears in the above-identified patent and that said Letters Patent is hereby corrected as shown below:
Front Page of the Patent, under Item [19],
Top left-hand corner after "Lace" remove ", Jr."

Signed and Sealed this

Nineteenth Day of September, 1989

*Attest:*

DONALD J. QUIGG

*Attesting Officer*

*Commissioner of Patents and Trademarks*